United States Patent [19]

DeLano

[11] 4,099,820

[45] Jul. 11, 1978

[54] LAMP SOCKET

[75] Inventor: Don L. DeLano, Mt. Clemens, Mich.

[73] Assignee: Microdot Inc., Greenwich, Conn.

[21] Appl. No.: 802,457

[22] Filed: Jun. 1, 1977

[51] Int. Cl.[2] ..... H01R 33/46

[52] U.S. Cl. ..... 339/88 R; 339/188 R; 339/278 L

[58] Field of Search ..... 339/88 R, 90 R, 189 L, 339/278 L, 187, 188 R, 190

[56] References Cited

U.S. PATENT DOCUMENTS

| | | | |
|---|---|---|---|
| 2,443,743 | 6/1948 | McNabb | 339/88 R |
| 3,569,907 | 3/1971 | Landgraf | 339/88 R |

*Primary Examiner*—Roy Lake
*Assistant Examiner*—E. F. Desmond
*Attorney, Agent, or Firm*—Harness, Dickey & Pierce

[57] ABSTRACT

The disclosure relates to a socket for a vehicle light bulb. The sides of the socket are cut or embossed to provide oppositely disposed J-slots having circumferentially extending portions for the seating of retaining pins on the light bulb. A cut or embossed slot is provided in the wall at one side, 90° from the J-slots, for orienting the bulb relative to the socket. The socket may be used as original equipment or as a replacement part for a damaged socket.

1 Claim, 8 Drawing Figures

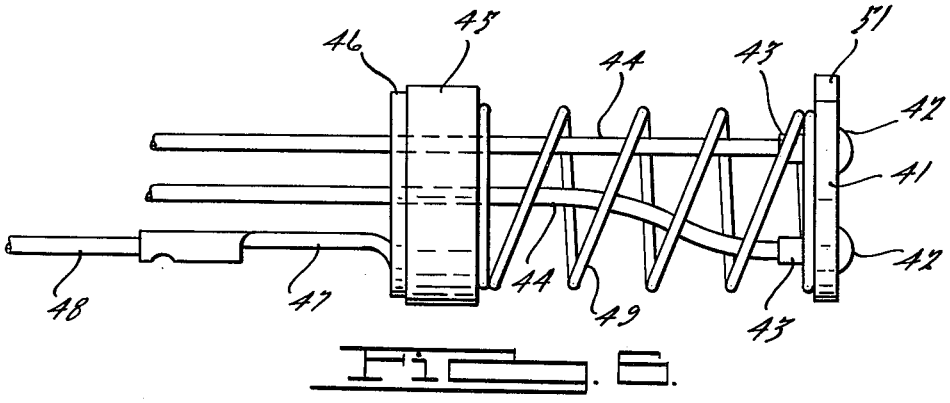
FIG. 6.
FIG. 7.
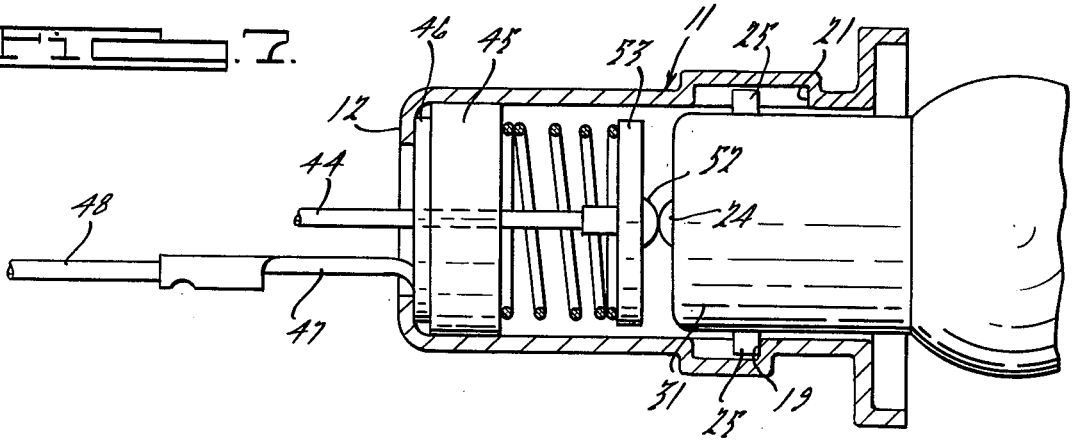
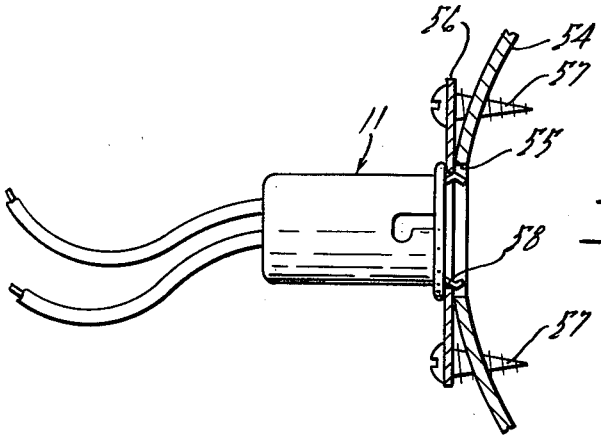
FIG. 8.

LAMP SOCKET

BACKGROUND OF THE INVENTION

Heretofore, different types of sockets have been utilized to accept light bulbs with a single terminal as opposed to light bulbs having two terminals in the base. In accordance with the present invention, a single socket is constructed to receive and support both single and double terminal light bulbs.

SUMMARY OF THE INVENTION

The invention pertains to the provision of a socket which will accept light bulbs of either the single or multi-terminal type so as to reduce the number of sockets required to be inventoried to satisfy market requirements. Diametrically disposed J-slots have portions radially aligned at one end of the socket to accept radially aligned pins on the bulb base. However, one of the J-slots has a pin seating portion of greater axial dimension than the other so as to receive a radially projecting pin on certain types of bulbs which are offset axially from one another. When the pins are radially aligned, only one pin retains the bulb within the socket.

BRIEF DESCRIPTION OF THE DRAWINGS

FIG. 6 is a view in elevation of a modified double contact terminal with a spring unit for a double terminal bulb which embodies features of the present invention;

FIG. 7 is a view of structure, similar to that illustrated in FIG. 6, showing the terminal thereof in combination with a modified socket and light bulb; and FIG. 8 is a sectional view of another embodiment of the socket suitable for use as a replacement socket.

DESCRIPTION OF THE PREFERRED EMBODIMENT

Figure 1:
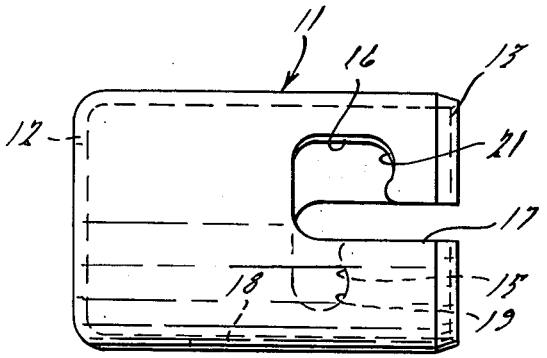
FIG. 1 is a view of a socket having J-slots through opposite sides thereof which accept different types of bulbs either of the single or the double terminal type.
Figure 2:
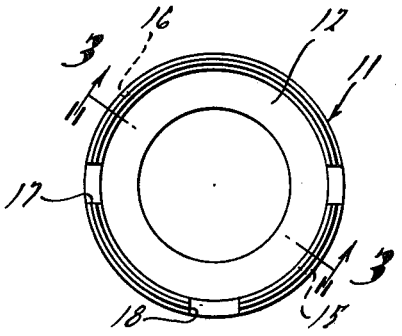
FIG. 2 is an end view of the structure illustrated in FIG. 1 as viewed from the righthand end thereof.
Figure 3:
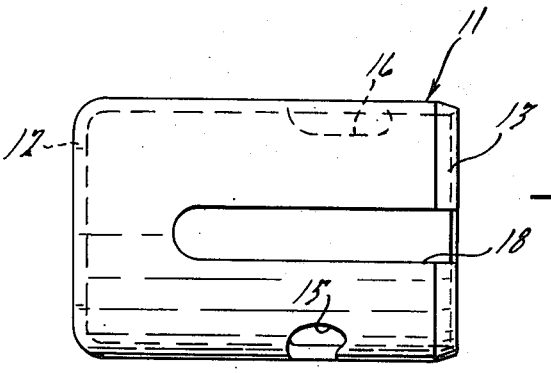
FIG. 3 is a view of the structure illustrated in FIG. 1 rotated 90°.

A socket 11 is constructed in accordance with the present invention to accommodate light bulbs of the single or double terminal type so as to reduce the inventory required for repairing defective sockets. The socket 11 comprises a metal sleeve having a radially inwardly directed flange 12 at one end thereof and chamfered portions 13 and 14 at the other end. J-slots 15 and 16 are cut or drawn in the sleeve wall and are defined in part by axially extending cut out or slot portions 17 disposed in diametrically opposed relation. An elongated slot 18 is provided between the straight slot portions 17 by which a finger on the edge of a terminal disc orients a pair of contacts carried thereby.

In accordance with the present invention, the J-slots 15 and 16 have enlarged cut-out or embossed portions circumferentially offset from the slot portions 17 to provide pin seats 19 and 21. More specifically, the J-slot 15 has the pin seat 19 disposed at a first spacing relative to the flange 12 on the socket 11, to receive one of the projecting pins 25 on a lamp base when said lamp base is rotated into anchoring relation therewith. The J-slot 16 has the pin seat 21 disposed at a greater distance from the flange 12 to receive either the other pin 25 on a single terminal lamp, see FIG. 4, or an offset pin 33, see FIG. 5, on a two-terminal lamp. By providing a socket 11 having the aforesaid J-slot configuration, the number of sockets required to be stocked is substantially reduced as a single socket can be employed to accept bulbs having one or a pair of terminals.

Figure 4:
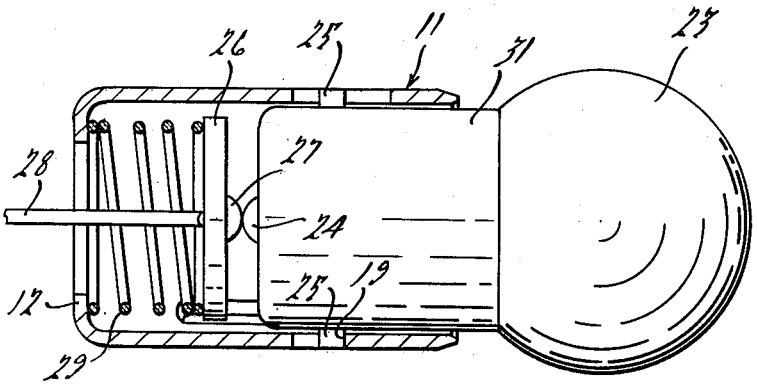
FIG. 4 is a sectional view of the socket illustrated in FIG. 1 showing a terminal and a light bulb of the single terminal type.

In FIG. 4, the socket 11 is shown in combination with a light bulb 23 having a single contact 24 with pins 25 extending from opposite sides of the base in radially aligned relation. An insulating terminal disc 26 has a single central contact 27 connected to a conductor 28 which passes outwardly through the inwardly directed flange 12 of the socket 11. The disc 26 and conductor 28 are biased toward the bulb 23 by a spring 29 which extends between the flange 12 and the disc 26. The contact 27 on the disc 26 makes contact with the contact 24 of the light bulb 23. As seen in FIG. 4, the upper pin 25 does not contact the pin seat 21 at the top of the J-slot 16.

Figure 5:
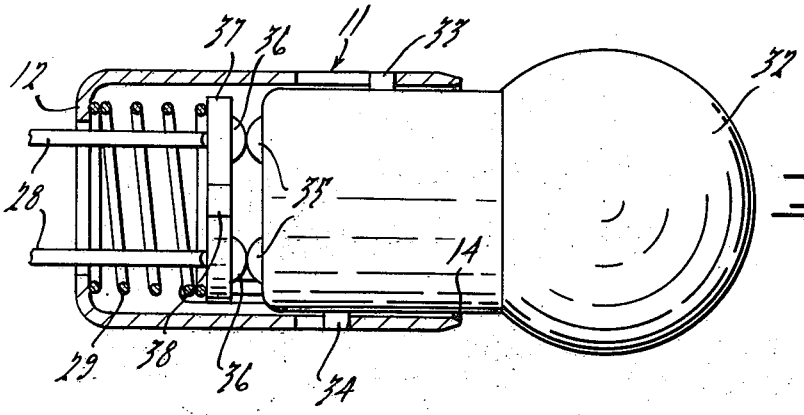
FIG. 5 is a socket similar to that illustrated in FIG. 4 showing a terminal and a light bulb of the two-terminal type.

In FIG. 5, as light bulb 32 is illustrated having pins 33 and 34 which are axially offset relative to each other an amount which is equal to the axially spaced relation of the pin seats 19 and 21 in the J-slots 15 and 16. A pair of terminals 35 on the light bulb 32 engage a pair of terminals 36 on an insulating disc 37. The disc 37 has a peripheral finger 38 extending within the slot 18 in the wall of the socket 11 to orientate the disc 37 and therefore the two terminals 36 thereon so as to be aligned with the terminals 35 on the light bulb base which in turn are oriented by the axial offset relation of the pins 33 and 34. The terminals 36 have conductors 28 extending therefrom and the disc 37 is urged toward the light bulb by the spring 29 disposed between the flange 12 of the socket 11 and the disc 37.

Referring to FIGS. 6 and 7, an insulating disc 41 has a pair of terminals 42 with extensions 43 connected to conductors 44. The conductors pass through a sealing element 45 and through a metal washer 46 having a connector 47 thereon to which a ground wire 48 is secured. A coiled spring 49 is disposed about the conductors 44 between the sealing element 45 and the insulating disc 41. It will be noted that the insulating disc 41 has an index tab 51 which orients the two terminals 42 relative to a socket.

In FIG. 7, a similar but single terminal assembly is illustrated mounted within an embossed socket 11 of the present invention. The inturned flange 12 of the socket 11 is engaged by the washer 46, a single terminal 52 being joined to a conductor 44 and supported by an insulating disc 53. A bulb 31 has one pin 25 engaged with an embossed pin seat 19 while the other radially aligned pin 25 is spaced from the embossed pin seat 21. When the bulb 31 is secured in the position as illustrated, the bulb terminal 24 engages the terminal 52 on the terminal disc 53 the spring 49 being compressed so as to bias the element 45 and washer 46 into engagement with the flange 12 and inner wall of the socket 11 to form a grounding connection and seal therewith. The metal washer 46 forms a ground when the socket 11 is used in an insulating member and the seal prevents the entry of water into the socket 11. In the event the assembly illustrated in FIG. 6 is utilized in the socket 11 of FIG. 7, a bulb having two contacts and axially offset pins will be accepted and properly orientated.

In FIG. 8, a further construction is illustrated which can be used when the socket for a reflecting element 54 has deteriorated. The element 54 has a central aperture 55 for the acceptance of a bulb (not shown). A metal backup plate 56 is adapted to be secured over the aperture by screws 57. An aperture 58 is provided in the plate 56 the same size as the original aperture 55 to permit the replacement socket 11 to be attached to the reflecting elements 54, herein illustrated as by the use of a plurality of spring fingers 59. The aperture 58 in the plate 56 may have notches or be otherwise formed to mount the socket 11 therein as is conventional in the art.

While it will be apparent that the invention herein disclosed is well calculated to achieve the benefits and advantages as hereinabove set forth, it will be appreciated that the invention is susceptible to modification, variation and change without departing from the spirit thereof.

What is claimed:

1. A socket capable of accepting conventional single or multicontact light bulbs having radially aligned or axially offset retention pins in the base thereof, respectively, said socket comprising a cylindrical sleeve having a radially inwardly extending flange at one end thereof, first and second diametrically related J-slots in said sleeve defined by axial slots and circumferentially offset open spaces with pin seats at the ends thereof remote from the flange on said sleeve, the pin seat in said first J-slot and closest to said flange being in radial alignment with an enlarged open space defined by the offset portion in said second J-slot, the pin seat in the offset portion of said second J-slot being axially spaced a distance from the pin seat in said first J-slot exactly equal to the spacing of the axially offset pins of a conventional multi-contact light bulb whereby single contact light bulbs having axially aligned retention pins as well as multi-contact light bulbs having axially offset retention pins are acceptable and positively supported by the pin seats in said socket.

* * * * *